United States Patent [19]

Knoll et al.

[11] 4,305,797

[45] Dec. 15, 1981

[54] MATERIAL SEPARATION BY DIELECTROPHORESIS

[75] Inventors: Frank S. Knoll, Jacksonville, Fla.; Joseph B. Taylor, Atlanta, Ga.

[73] Assignee: Carpco, Inc., Jacksonville, Fla.

[21] Appl. No.: 209,371

[22] Filed: Nov. 24, 1980

[51] Int. Cl.[3] ..... B03C 5/00

[52] U.S. Cl. ..... 204/180 R; 204/186; 204/300 R; 204/302; 55/2; 55/113; 55/116

[58] Field of Search ..... 204/180 R, 186, 213, 204/302, 300; 55/113, 116, 2, 12

[56] References Cited

U.S. PATENT DOCUMENTS

| | | | |
|---|---|---|---|
| 3,893,898 | 7/1975 | Candor | 204/180 R |
| 4,033,841 | 7/1977 | Candor | 204/301 X |
| 4,100,068 | 7/1978 | Jordan et al. | 204/10 R X |
| 4,101,400 | 7/1978 | Pepping | 204/180 R |
| 4,208,807 | 6/1980 | Candor | 204/180 R X |

*Primary Examiner*—Arthur C. Prescott

*Attorney, Agent, or Firm*—Arthur G. Yeager

[57] ABSTRACT

An apparatus and method are provided for separating electrically neutral solid materials having different dielectric, shape, density or dipole moment properties by passing a mixture of such materials through a nonuniform electric field generated between an electrically charged arcuate surface and a flat horizontal grounded surface having a receiving end, a discharge end and two lateral edges, said arcuate surface being spaced above said horizontal surface and extending from about said receiving end to about said discharge end and from one of said lateral edges to at least midway between said lateral edges; a means for introducing said solid materials into the electric field near said receiving end and conducting said material through the field to said discharge end; and recovering one type of material from said lateral edge adjacent said arcuate surface and another type of material from said discharge end of the horizontal surface.

40 Claims, 5 Drawing Figures

MATERIAL SEPARATION BY DIELECTROPHORESIS

BACKGROUND OF THE INVENTION

It is apparent to all that waste materials from homes, businesses, manufacturing operations, etc. are being produced in larger and larger amounts and thereby are causing disposal problems which are becoming increasing difficult to solve. Atmospheric pollution results from attempts to burn such waste materials to reduce its volume to that of ashes. The only other viable solution is to recycle these waste materials to be used over and over again in the production of new products. While recycling is a popular and deserving solution, it is often extremely difficult to separate one type of material from another in order to concentrate any particular material for recycling. Furthermore, many of such waste products are so small in size that the separation problems assume such gigantic proportions that they appear to be completely impractical.

The use of electric energy in separation processes has been employed many times in the past, e.g. in electostatic separators for dust particles and such small sized materials. In some types of separation procedures particles are given an electric charge and then attracted to a surface of the opposite electric charge and removed from that surface. Other electrical methods of separation are well known to the skilled engineers in this field.

Another development employs a nonuniform electric field to act upon certain neutral particles causing those particles to move toward the location where the electric field has its highest intensity. This phenomenon is called dielectrophoresis. When neutral particles having suitable dielectric, dipole moment or shape differences are subjected to a nonuniform electric field they become polarized, frequently referred to as "dipoles", having an equal amount of plus and minus charges each concentrated on opposite sides of the particle, which causes the particle to become oriented so that its plus charges are attracted to the minus electrode and its minus charges are attracted to the plus electrode. Such a particle in a uniform electric field will not move in any direction because the forces acting upon it are balanced. In a nonuniform electric field, however, an analysis of the forces acting upon the particle shows that the particle will tend to move toward the location of highest field intensity. For example, in a field developed between a small sphere and a flat plate the location of highest field intensity is at the surface of the sphere and accordingly the particles will move toward the sphere. A detailed explanation of this phenomenon can be found in "ELECTROSTATIC AND IT'S APPLICATION", Wiley-Interscience, 1973, Chapter 14.

The principle of dielectophoresis has been employed in U.S. Pat. No. 3,162,592 to H. A. Pohl in describing a method and apparatus for separating materials by subjecting them to a nonuniform electric field. In this patent a mixture of particles, e. g. rutile and polyvinylchloride are introduced to an inclined trough over which is positioned an arcuate electrode. Under the trough is a uniform metal plate serving as an electrode and a field is generated between the curved electrode above the trough and the metal plate below the trough. This field is nonuniform because of the shape of the curved electrode above the trough and it acts upon the mixture of particles sliding down the inclined trough. By the time the particles reach the end of the trough the field has acted upon the particles and caused a significant separation in which the rutile particles are deflected by the electric field and the polyvinylchloride particles are substantially unaffected by the electric field. The entire zone of the electric field in this patent takes place in a dielectric liquid such as benzene.

It is an object of this invention to provide a novel apparatus and method for separating materials by dielectrophoresis.

It is another object of this invention to provide a separation process where the nonuniform electric field is produced in a medium of air. It is another object of this invention to provide a nonuniform electric field between a rotating convex surface and a flat surface to provide an improved separation process.

It is still another object of this invention to provide a continuous separation process whereby a conical electrode is rotated and continuously cleaned of any particles clinging to the surface which might adversely affect the functioning of the separation process.

Still other objects will appear from the more detailed description of this invention which follows.

BRIEF SUMMARY OF THE INVENTION

This invention provides an apparatus and method for separating electrically neutral solid particles having different dielectric, dipole moment, shape or density properties from a mixture thereof. Such apparatus includes an electrically conductive grounded substantially horizontal surface having a receiving end and a discharge end, an electrically charged electrode having an arcuate surface spaced above the horizontal surface and extending substantially over the entire length of the horizontal surface from the receiving end to the discharge end. The perpendicular distance from one lateral edge of the horizontal surface to the arcuate surface is less than that at any other location of the horizontal surface, and the perpendicular distance between the horizontal surface and the arcuate surface along the lateral edge is substantially constant over the entire length of the arcuate surface. A trough means or the like introduces a mixture of electrically neutral solid particles of different dielectric properties onto the horizontal surface. A conveyor or the like is provided to move the particles at a steady rate across the horizontal surface from the receiving end to the discharge end. Collection means or the like receive and recover particles from the discharge end of the horizontal surface while other means receive and recover particles from the lateral edge of the horizontal surface.

In specific embodiments of this invention the charged electrode is a truncated conical surface or a cylindrical surface which is rotated about its axis and which includes means for removing any of the neutral solid particles clinging to its surface. In a preferred embodiment of this invention the horizontal surface is vibrated in such a fashion as to cause the solid neutral particles to move across the horizontal surface from the receiving end to the discharge end and to break up and distribute clumps of such particles somewhat evenly across the horizontal surface.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawing in which:

DETAILED DESCRIPTION OF THE INVENTION

This invention is directed at a method and an apparatus for separating one type of electrically neutral particle from another type of electrically neutral particle. It is well known that particles which have one charge or the other, i.e. plus or minus, when placed in an electric field between two electrodes will be attracted to the electrode having the opposite charge from that of the particle. The present invention is not concerned with charged particles, i.e. those in which the plus and minus charges are not equally balanced, but rather with neutral particles which have an exactly equal balance of both charges. Such neutral particles are not attracted to either the plus or the minus electrode when they are placed in a uniform electric field, e.g. one generated between parallel electrodes. In such a field the neutral particle becomes polarized, the strength of the polarization depending upon its dielectric, density and/or shape differences. When the particle becomes polarized it has an equal amount of plus and minus charges so that there is no net plus or minus charge, but the particle becomes oriented such that the side of the particle with plus charges faces the negative electrode and the side with the negative charges faces the positive electrode. The particle does not move in any direction through the field but merely rotates about its own axis until it is oriented according to its polarization. In a nonuniform electric field, e.g. one generated between nonparallel irregular shaped electrodes, the neutral polarized particle is actually subjected to a net force which causes it to move through the electric field toward the zone of highest field intensity. Thus, if one electrode is a small sphere and the other electrode is a flat plate, a nonuniform field will be generated between these electrodes with the highest intensity being close to the spherical electrode because of its small size compared with the plate electrode. In such a field the neutral particles will move toward the spherical electrode. It is immaterial whether the field is generated by D.C. electricity flowing in one direction or A. C. electricity alternating in both directions; the neutral polarized particle will, nevertheless, move through the electric field toward the highest field intensity. This invention deals with the generation of a nonuniform electric field and the utilization of that field to separate electrically neutral particles of one type from those of another type.

Figure 1:
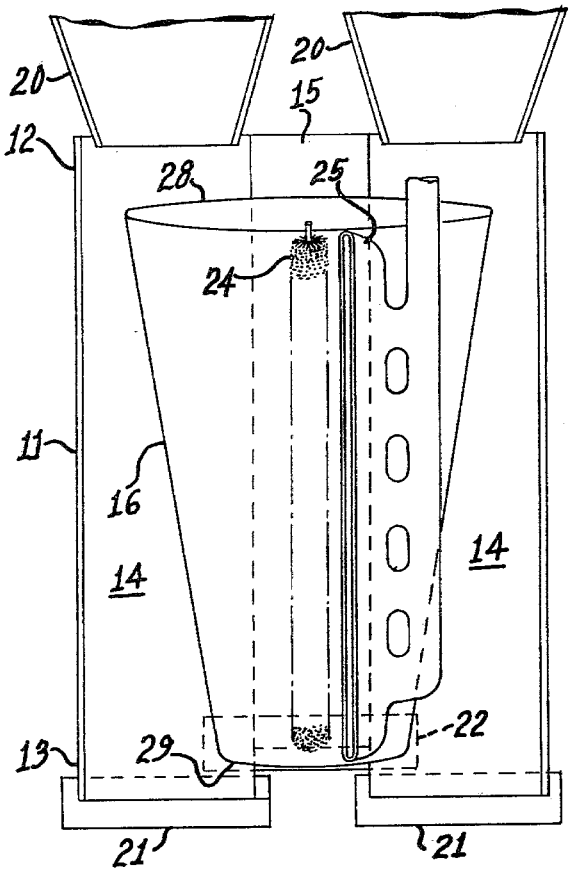
FIG. 1 is a top plan view of the preferred apparatus of this invention employing a conical electrode.
Figure 2:
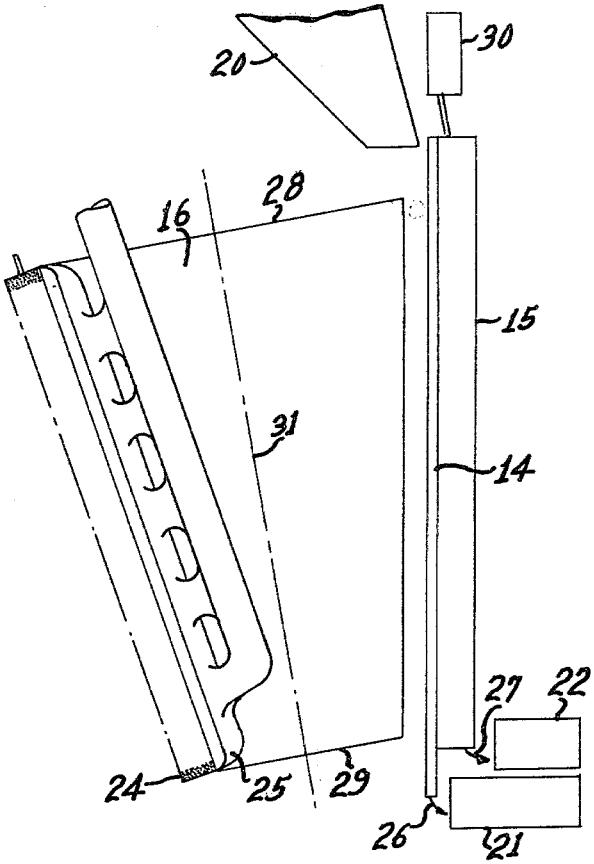
FIG. 2 is a side elevational view of the apparatus of FIG. 1.
Figure 3:
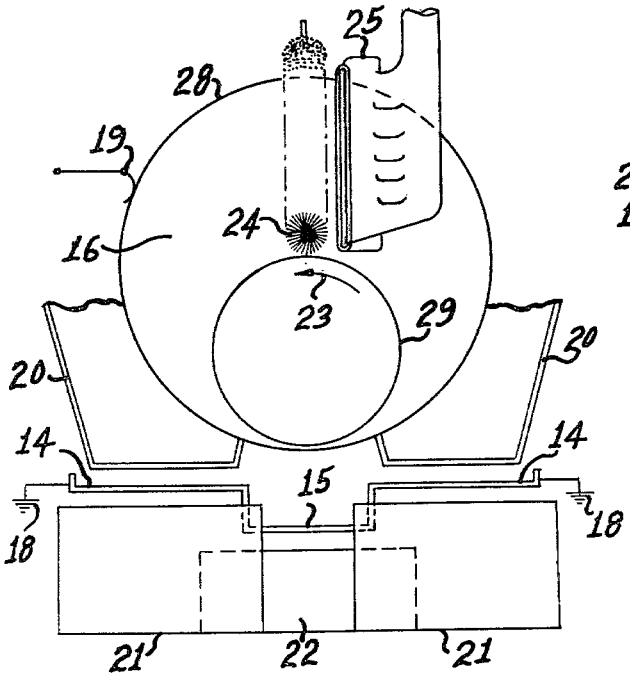
FIG. 3 is a front elevational view of the apparatus of FIG. 1.

In the attached drawings there is shown the preferred apparatus employed to effect such a separation. A nonuniform electric field is generated between the flat horizontal surface 11 and the curved surface of electrode 16, which in the embodiment shown in FIGS. 1–3 is in the shape of a truncated cone. Surface 11 has a receiving end 12, a discharge end 13, two side sections 14, and a central space 15. Electrode 16 is positioned such that the large end 28 is adjacent to the receiving end 12 of surface 11, and the small end 29 is adjacent the discharge end 13 of surface 11. Surface 11 has two parallel side sections 14 in substantially the same plane separated by a central space 15 running from receiving end 12 to discharge end 13. Side sections 14 include an electrically conductive plate at the surface or immediately below the surface which is joined to ground connections 18. Electrode 16 is joined by suitable connection 19 to a source of electric energy to charge electrode 16. These electrical connections produce a nonuniform electric field between the surface of electrode 16 and each of the two side sections 14 and central space 15. Space 15 may be a depressed trough of nonconductive material, as shown in FIG. 3, or it may be merely a void space of air between the inner edges of side sections 14 that allows for collection of the attracted or diverted material laterally therefrom.

The particles to be separated are fed through chutes 20 to receiving end 12 of surface 11 to side sections 14. Some conveying means must be provided to advance the particles from receiving end 12 to discharge end 13 and there are many possibilities for this operation. A preferred embodiment is to employ a means 30 to suitably vibrate surface 11 to cause the particles to move from receiving end 12 to discharge end 13. Surface 11 may be inclined downwardly from receiving end 12 to discharge end 13 so as to take advantage of the force of gravity in helping to move the particles across the length of the table. Another suitable means for accomplishing this purpose is to have endless belt conveyors forming side sections 14 which will move the particles on the conveyor from receiving end 12 to discharge end 13. Some means of agitating the mixture of particles fed to receiving end 12 from chutes 20 is preferable so as to break up any clumps of material and distribute them somewhat evenly across the width of said sections 14 and therefore a vibrating means is one of such preferred embodiments.

The particles spread across the surface of side sections 14 and come under the influence of the nonuniform electric field as soon as they pass under large end 28 of electrode 16. As the particles move toward receiving end 13 that field becomes more and more intense toward the center of surface 11, i.e. over the inner edges of sections 14 adjacent central space 15. Since the polarized particles or particles of high dielectric constant move toward the area of highest intensity of the electric field it means that these particles will tend to move toward central space 15 as they are moved toward receiving end 13. If the particles are light enough to be bounced into the air by the movement of surface 11 the electric field will cause the particles to move through the air toward the centerline of space 15. If the particles are heavy enough to remain on the table, the field, nevertheless, will cause the particles to move in the same direction toward the centerline of space 15. Those particles in the mixture which are not sufficiently polarized to be affected strongly by the electric field will simply move from receiving end 12 to discharge end 13 along side sections 14 with little or no lateral movement toward the center of space 15. The particles that are influenced by the electric field will move toward space 15, and the particles will then drop below the level of said sections 14 and be collected in a container or moved forward in a trough (as shown in FIG. 3) to be discharged from the end of the trough into container 22. This action concentrates at central space 15 those particles which are easily moved by the action of the electric field and leaves on side sections 14 the remaining particles which are relatively unaffected by the electric field, thus effecting a separation of different types of particles. As the particles continue to move toward receiving end 13 they eventually reach the end of surface 11 and drop into receiving bins 21 and 22, the former collecting the particles from side sections 14 and the latter collecting the particles from central trough 15.

It is not necessary that surface 11 include two side sections 14 separated by a central space 15. The apparatus shown in these drawings would function if one of the two side sections 14 were omitted. Particles affected by the electric field would be moved toward space 15 and fall over the edge to be collected below the level of side section 14, while the unaffected particles would travel on to receiving end 13 and fall over the edge into bin 21.

Figure 5:
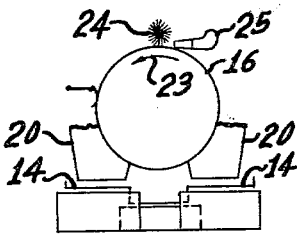
FIG. 5 is a schematic front elevational view of the apparatus of FIG. 4.
Figure 4:
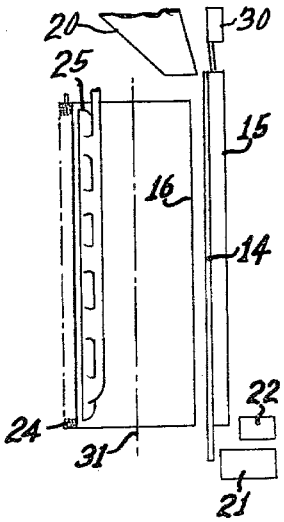
FIG. 4 is a schematic side elevational view similar to FIG. 2, except the electrode is shown to be cylindrical.

The shape of electrode 16 is conical in FIGS. 1–3. The shape can be other than conical, e.g. cylindrical as shown in FIGS. 4–5. Other shapes similar to conical and cylindrical are also operable. The shape generated by rotating a straight line about an axis in the same plane as the stright line is either a cone or a cylinder. If the rotated line is slightly curved the surface will resemble conical or cylindrical and can also be used in this invention. Electrode 16 may be solid or hollow, i.e. tubular, but preferably is tubular.

It nearly always happens that some fine particles will actually touch the surface of electrode 16 and be held there by electric attraction. This causes the efficiency of the system to be reduced as more and more particles collect on the surface of electrode 16 and reduce its ability to generate the electric field. Accordingly, it is preferred in this embodiment of this invention for electrode 16 to rotate about its longitudinal axis 31 (see FIGS. 2 and 4) as shown in the direction of arrow 23 and to be cleaned of such particles when they reach a position remote from the electric field at surface 11. A suitable means for cleaning the surface is a brush 24, which preferably is a rotating brush, in combination with a vacuum head 25 to remove those particles swept from the surface of rotating electrode 16. The rotation of electrode 16 has no effect whatsoever on the electric field. The field is generated in exactly the same fashion and in exactly the same position whether electrode 16 rotates or does not move.

In a comparison between an apparatus of the type shown in FIGS. 1–3 and a conventional roll-type electrostatic separator, both were employed for the purpose of separating a mixture of pieces of coated paper and pieces of polystyrene plastic all of the pieces having a size range of 0.5 to 1.0 inch. The electrostatic separator was fed a mixture averaging 62 pieces of paper and 38 pieces of plastic per 100 pieces in the mixture. The electrostatically attracted product of the separation contained 44 pieces of paper; the unattracted product contained a mixture of 18 pieces of paper and 38 pieces of plastic, which in percentage figures means that only 59.1% of the paper was separated from the mixture. The separator of the present invention was fed a mixture of 68.5 pieces of paper and 31.5 pieces of plastic per 100 pieces in the mixture. The product of the separation showed complete separation of all paper from all plastic, or a 100% separation.

Other examples in accord with this invention, have been developed to separate other coarse particles (at least 1 mm in maximum dimension) of fibers from plastics and rubber, paper from film, hulls or shells from the nut or meat of guar beans and sunflower seeds, stems from raisins, and other agricultural products. The coarse separation in accord with this invention preferably should be made on materials or particles which are at least 1 mm or 16 mesh for efficient separation by employing the apparatus and method herein disclosed. The nonuniform electric field between electrode 16 and surface 11 is generated by applying a charge of between 5 and 100 kv to electrode 16 and the surface 11 is preferably from about 1 to 6 inches away from electrode 16 to effect efficient separation of the polarizable particles from the non polarizable particles.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A method of separating a mixture of different electrically neutral solid particles comprising (a) introducing a mixture of different electrically neutral solid particles onto the inlet end of a substantially horizontal surface;

(b) conveying said mixture of particles along a longitudinal path on said surface while subjecting said particles to a nonuniform electric field in air, said field being strong enough to cause polarizable particles or particles of higher dielectric constant to move transversely across said path while being conveyed longitudinally;

(c) recovering from the edge of said electric field where the field intensity is at a maximum a portion of said particles highly concentrated with respect to those particles that are readily moved transversely of said path; and (d) recovering from the outlet end of said horizontal surface the remaining portion of said particles highly concentrated with respect to those particles that move substantially longitudinall of said path.

2. The method of claim 1 wherein said electric field is generated between said horizontal surface being grounded and an electrically charged tubular electrode suspended over said longitudinal path.

3. The method of claim 2 which includes the step of continuously rotating said tubular electrode about its lontitudinal axis.

4. The method of claim 3 which includes the step of continuously cleaning said tubular electrode to remove any solid materials clinging thereto.

5. The method of claim 1 wherein said particles are conveyed by vibrating said horizontal surface.

6. The method of claim 2 wherein said electric field is generated by applying a charge of 5–100 kV to said electrode.

7. The method of claim 2 wherein said electrode and said horizontal surface are positioned about 1–6 inches apart.

8. The method of claim 1 wherein said particles are conveyed along two spaced parallel longitudinal paths separated by a depressed space, said space being the location for the recovery of said particles that are readily moved transversely of said path.

9. The method of claim 1 wherein said particles are at least 1 mm. in maximum dimension.

10. A method of separating a mixture of polarizable and non-polarizable electrically neutral solid coarse particles comprising (a) introducing the mixture of particles onto the inlet end of a substantially horizontal surface;

(b) conveying the mixture of particles along a longitudinal path on the surface while subjecting the particles to a nonuniform electric field in air, the field being strong enough to cause polarizable particles to move transversely across the path while being conveyed longitudinally;

(c) recovering from the edge of the electric field where the field intensity is at a maximum the polarizable particles; and (d) recovering from the outlet end of the horizontal surface the non-polarizable particles that moved substantially longitudinally and completely along the path.

11. The method of claim 10 wherein the electric field is generated between the horizontal surface being grounded and an electrically charged tubular electrode suspended over the longitudinal path.

12. The method of claim 11 which includes the step of continuously rotating the tubular electrode about its longitudinal axis.

13. The method of claim 12 which includes the step of continuously cleaning the tubular electrode to remove any solid fine materials clinging thereto.

14. The method of claim 1 wherein the mixture of particles are conveyed by vibrating the horizontal surface.

15. The method of claim 2 wherein the electric field is generated by applying a charge of 15–100 kV to the electrode.

16. The method of claim 2 wherein the electrode and the horizontal surface are positioned about 1–6 inches apart.

17. The method of claim 10 wherein the mixture of particles are conveyed along two spaced parallel longitudinal paths separated by a depressed space, the space being the location for the recovery of the polarizables that are reaily moved transversely of the path.

18. The method of claim 10 wherein the particles in the mixture are at least 1 mm. in maximum dimension.

19. A method of separating a mixture of low and high dielectric contants, electrically neutral, solid, coarse particles comprising (a) introducing the mixture of particles onto the inlet end of a substantially horizontal surface;

(b) conveying the mixture of particles along a longitudinal path on the surface while subjecting the particles to a nonuniform electric field in air, the field being sufficiently strong to cause high dielectric constant particles to move transversely across the path while being conveyed longitudinally;

(c) recovering from the edge of the electric field where the field intensity is at a maximum the high dielectric constant particles; and (d) recovering from the outlet end of the horizontal surface the low dielectric constant particles that moved substantially longitudinally and completely along the path.

20. Apparatus for separating electrically neutral solid particles of different dielectric dipole moment, shape and/or density properties from a mixture thereof comprising an electrically conductive grounded substantially horizontal surface having a receiving end, a discharge end, and two lateral edges;

an electrically charged electrode having an arcuate surface spaced above said horizontal surface and extending substantially over the entire length of said horizontal surface from said receiving end to said discharge end, the perpendicular distance from one lateral edge of said horizontal surface to said arcuate surface being less than that measured at any location away from said lateral edge, and the perpendicular distance between said horizontal surface and said arcuate surface along said lateral edge being substantially constant over the entire length of said arcuate surface;

means for introducing a mixture of electrically neutral solid particles of different dielectric properties onto said horizontal surface;

means for charging said electrode;

means for moving said particles at a steady rate across said horizontal surface from said receiving end to said discharge end;

means for recovering particles from said discharge end of said horizontal surface; and means for recovering particles from said lateral edge of said horizontal surface.

21. Apparatus of claim 20 which additionally comprises means for rotating said electrode about its longitudinal axis.

22. Apparatus of claim 21 which includes a means for removing from the surface of said electrode solid materials clinging to the surface thereof.

23. Apparatus of claim 22 wherein said means for removing includes a brush to sweep said clinging materials from the surface of said electrode.

24. Apparatus of claim 22 wherein said means for removing includes a vacuum cleaner directed at said clinging solid materials.

25. Apparatus of claim 22 wherein said means for removing is located remotely from said horizontal surface.

26. Apparatus of claim 20 wherein said means for moving particles includes a vibrator applied to said horizontal surface.

27. Apparatus of claim 20 wherein said horizontal surface comprises two horizontally spaced surfaces separated from each other in the area vertically below portions of said electrode which are positioned closest to said horizontal surface.

28. Apparatus of claim 20 wherein said arcuate surface is a surface of revolution produced by rotating about an axis a line lying in the same plane as said axis.

29. Apparatus of claim 28 wherein said arcuate surface is generally conical.

30. Apparatus of claim 28 wherein said arcuate surface is generally cylindrical.

31. Apparatus of claim 20 wherein said horizontal surface is a conveyor.

32. Apparatus for separating electrically neutral solid particles of different dielectric dipole moment, shape and/or density properties from a mixture thereof comprising two spaced surfaces in substantially the same horizontal plane, each having a receiving end, a discharge end, an inner lateral edge and an outer lateral edge, said surfaces being electrically conductive and being grounded, and the space between said inner lateral edges being electrically nonconductive and extending substantially entirely from said receiving ends to said discharge ends;

an electrically charged electrode having a smooth surface having the shape of one generated by rotating about an axis a substantially straight line lying in the same plane as the axis, said electrode being positioned with its axis vertically above the longitudinal centerline of said space between inner lateral edges and positioned such that said substantially straight line is substantially parallel to and closely adjacent to said centerline in said horizontal plane;

means for electrically charging said electrode;

means for introducing a mixture of electrically neutral solid particles of different dielectric properties onto said two spaced surfaces at said receiving ends;

means for moving said particles across said spaced surfaces to said discharge ends; and means for recovering particles in said space between said inner lateral edges and for recovering particles from said discharge ends.

33. Apparatus of claim 32 which additionally comprises a means for rotating said electrode about its longitudinal axis.

34. Apparatus of claim 33 which includes a means for removing from the surface of said electrode solid materials clinging to the surface thereof.

35. Apparatus of claim 34 wherein said means for removing includes a brush to sweep said clinging materials from the surface of said electrode.

36. Apparatus of claim 34 wherein said means for removing includes a vacuum cleaner directed at said clinging solid materials.

37. Apparatus of claim 34 wherein said means for removing is located remotely from said spaced surfaces.

38. Apparatus of claim 32 wherein said spaced surfaces are vibrated to produce movement of solid materials thereon.

39. Apparatus of claim 32 wherein said electrode surface is substantially conical.

40. Apparatus of claim 32 wherein said electrode surface is substantially cylindrical.

* * * * *